US007849653B2

(12) United States Patent
Guertin

(10) Patent No.: US 7,849,653 B2
(45) Date of Patent: Dec. 14, 2010

(54) SPORT WALL AND SPORT WALL SYSTEM

(75) Inventor: Chris Guertin, Minneapolis, MN (US)

(73) Assignee: Sport Resource Group, Inc., Minneapolis, MN (US)

( * ) Notice: Subject to any disclaimer, the term of this patent is extended or adjusted under 35 U.S.C. 154(b) by 171 days.

(21) Appl. No.: 11/843,381

(22) Filed: Aug. 22, 2007

(65) Prior Publication Data

US 2009/0049785 A1 Feb. 26, 2009

(51) Int. Cl.
*E04B 2/00* (2006.01)

(52) U.S. Cl. ..... 52/582.1; 52/71; 52/588.1; 472/94

(58) Field of Classification Search ..... 52/71, 52/144, 146, 152, 293.3, 581, 588.1, 590.2, 52/589.1, 592.1; 256/26; 404/6, 9, 10; 472/92, 472/93, 94

See application file for complete search history.

(56) References Cited

U.S. PATENT DOCUMENTS

| | | | | | |
|---|---|---|---|---|---|
| 3,883,120 | A | | 5/1975 | Tippmann | |
| 5,452,963 | A | * | 9/1995 | Christensen | 404/6 |
| 5,498,101 | A | * | 3/1996 | Braverman | 404/6 |
| 5,706,625 | A | | 1/1998 | Vallance et al. | |
| 5,820,470 | A | * | 10/1998 | Saunders | 472/92 |
| 5,863,030 | A | | 1/1999 | Kotler et al. | |
| 5,953,882 | A | | 9/1999 | Vallance et al. | |
| 5,988,934 | A | * | 11/1999 | Wasserstrom | 404/6 |
| 5,993,103 | A | | 11/1999 | Christensen | |
| 6,004,217 | A | | 12/1999 | Johnston et al. | |
| 6,004,218 | A | * | 12/1999 | Keating et al. | 472/94 |
| D430,316 | S | | 8/2000 | Guertin | |
| 6,102,375 | A | * | 8/2000 | Colless et al. | 256/26 |
| 6,155,022 | A | | 12/2000 | DeCanio et al. | |
| 6,164,865 | A | * | 12/2000 | McCallum | 404/6 |
| D487,317 | S | | 3/2004 | Guertin | |
| 7,234,275 | B1 | * | 6/2007 | Haggy et al. | 52/71 |

(Continued)

FOREIGN PATENT DOCUMENTS

| | | |
|---|---|---|
| CA | 2170943 | 9/1997 |

(Continued)

OTHER PUBLICATIONS

PCT International Search Report for PCT/US2008/072480 dated Mar. 30, 2009.

(Continued)

*Primary Examiner*—Richard E Chilcot, Jr.
*Assistant Examiner*—Theodore Adamos
(74) *Attorney, Agent, or Firm*—Bridget M. Hayden; Dorsey & Whitney LLP

(57) ABSTRACT

An anchoring panel for a sport wall system with a front side facing an interior of the sport wall system, a back side, a flange extending from and rigidly fixed to the back side, a top side, a bottom side, and a first and second end wall is provided. Each of the first and second end walls include interlocking elements for interlocking with a first or second end of another panel in the sport wall system, the interlocking elements comprising at least a male knob extending towards the bottom side of the anchoring panel and configured to be insertable into a panel recess of the another panel in the sport wall system.

20 Claims, 12 Drawing Sheets

U.S. PATENT DOCUMENTS

| | | | | |
|---|---|---|---|---|
| 2002/0014619 | A1* | 2/2002 | Christensen et al. | 256/25 |
| 2002/0121063 | A1* | 9/2002 | Mathias et al. | 52/578 |
| 2007/0287548 | A1 | 12/2007 | Irving et al. | |
| 2009/0137329 | A1 | 5/2009 | Palumbo et al. | |

FOREIGN PATENT DOCUMENTS

| | | | |
|---|---|---|---|
| CA | 2311427 | | 7/1999 |
| CA | 2634767 | | 7/1999 |
| CA | 2552340 | | 12/2007 |
| CA | 2645480 | | 5/2009 |
| DE | 297 03 726 | U1 | 4/1997 |
| GB | 2 298 331 | A | 8/2004 |
| WO | WO 99/29984 | | 7/1999 |
| WO | WO 99/36648 | | 7/1999 |
| WO | WO 2007/143718 | | 12/2007 |

OTHER PUBLICATIONS

U.S. Appl. No. 12/466,828, filed May 15, 2009 entitled "Seamless plastic shielding dasher board system".

* cited by examiner

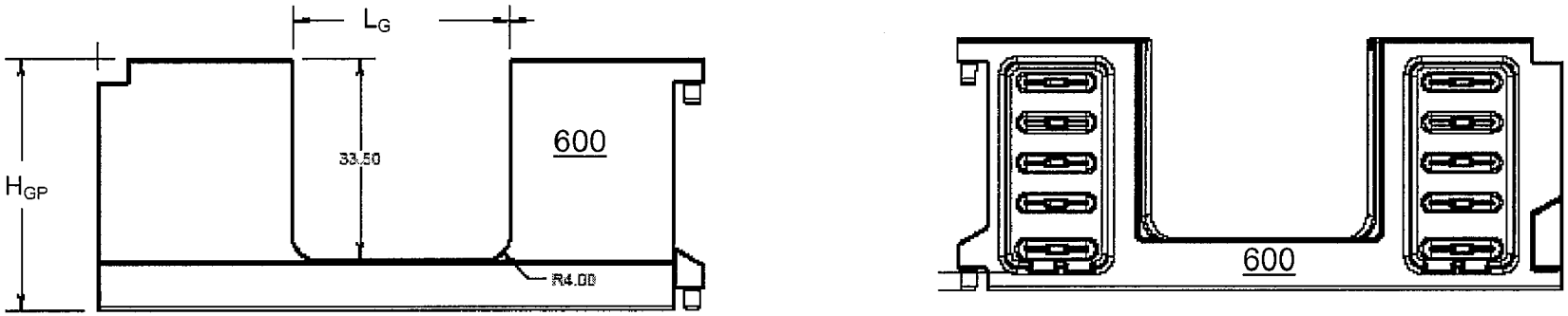
Fig. 6A
Fig. 6B
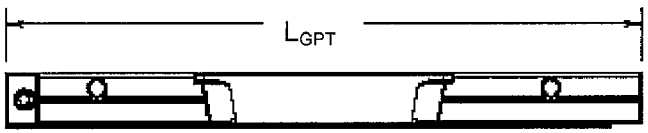
Fig. 6C
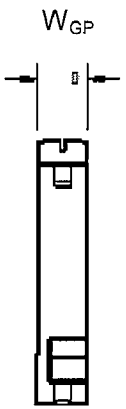
Fig. 6E
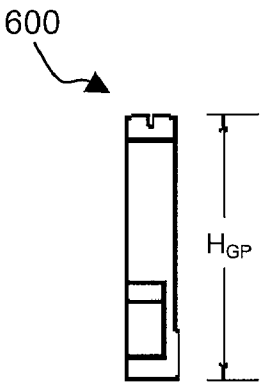
Fig. 6D
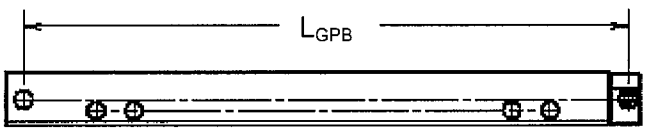
Fig. 6F

SPORT WALL AND SPORT WALL SYSTEM

FIELD OF THE INVENTION

The present invention relates to modular containment wall systems. In particular, the present invention relates to portable modular sport walls for use in athletic activities.

BACKGROUND

Athletic containment walls such as skating rink walls are considered to be dasherboards that are typically made of wood or fiberglass. As a result, dasherboard panels can be heavy and difficult to transport, assemble and adjust. In addition, dasherboard systems are designed to permanently affix to the ground and do not have bracing options that allow the dasherboards to be portable.

One reference, U.S. Pat. No. 5,863,030, issued Jan. 26, 1999, attempts to address the issues described above by providing a containment wall system that includes an assembly of panels, each panel having a first edge, an opposing second edge, and interlocking members configured and arranged for (i) interlocking the first edge to a first adjacent panel and (ii) interlocking the second edge to a second adjacent panel via coupling means such as anchoring rods that anchor into ground surfaces. Support legs are rotatably disposed on a back wall of the panels. Each support leg is removably attachable to at least three different attachment sites at the back wall of a panel. The interlocking, modular design of the containment wall enables quick and easy assembly and reassembly, as well as modification to form doorways, sitting areas and similar component structures. In one embodiment, the rear side of the panel includes a recess formed therein. During periods of nonuse, the support leg can be rotated into the recess in a storage position, permitting easy stacking and storage of the panels with the support legs neatly disposed in the rear recesses.

Problems associated with the above portable containment wall systems may involve damage to the anchoring rods, such as bending or breakage, difficult dowel removal, and instability of support legs due to their removable and rotational disposition on the panel.

Accordingly, there is a need in the art for providing a portable athletic containment wall system that is stable and easy to assemble and reassemble.

SUMMARY

Various embodiments of the invention address the issues described above by providing a modular sporting wall system for use in athletic activities that is stable, easy to assemble and reassemble, and that can be easily transported.

In one configuration, an anchoring panel for a sport wall system includes a front side facing an interior of the sport wall system; a back side, the front and back side comprising a length of about 18" to 108" and a height of about 24" to 48"; a top side and a bottom side, the front side and back side arranged therebetween; a first and second end wall, the front side and back side arranged therebetween, where the first and second end wall and top and bottom side form the width of the anchoring panel and is about 2" to 12"; at least two cylindrically-shaped male knobs arranged on the first end wall at an upper and lower portion of the anchoring panel via a flange extending from the end wall, where the male knobs extend from a bottom of the flange toward the bottom side of the anchoring panel, where the male knobs comprise a length of about 2" to 5" and a diameter of about 1" to 3½"; at least two end wall recesses arranged on the second end wall at an upper and lower portion of the anchoring panel, where each of the end wall recess is arranged in an end wall cutout and extends into the sport wall, the end wall recesses comprising a length of about 2" to 5" and a diameter of about 1" to 4"; and a flange extending from and rigidly fixed to the back side, the flange comprising a wedge-shape, where the flange height that is coupled to the back side is about 18" to 44" and a width of about 4" to 8", the wedge-shape of the flange widening as the flange extends to the bottom side of the anchoring panel, where at the bottom of the anchoring panel the flange comprises a length of about 18" to 36", where the flange comprises an opening and a hollow interior capable of receiving filling material.

In another embodiment, an anchoring panel for a sport wall system includes a front side facing an interior of the sport wall system; a back side; a top side and a bottom side, the front side and back side arranged therebetween; a first and second end wall, the front side and back side arranged therebetween, where each of the first and second end walls comprise interlocking elements for interlocking with a first or second end of another panel in the sport wall system, the interlocking elements comprising at least a male knob extending towards the bottom side of the anchoring panel and configured to be insertable into an end wall recess of the another panel in the sport wall system; and a flange extending from and rigidly fixed to the back side, the flange comprising a hollow interior capable of receiving filling material.

Another configuration is a sport wall system that includes a plurality of panels for forming an enclosed sporting area, each of the plurality of panels including a front side facing an interior of the enclosed sporting area; a back side; a top and bottom side, the front and back side arranged therebetween; first and second end walls, the front and back side arranged therebetween, where each of the first and second end walls comprise interlocking elements for interlocking with another of the plurality of panels, the first or second end wall interlocking elements comprising at least a male knob extending towards the bottom side of the anchoring panel configured to be insertable into a panel recess of the another first or second end of another of the plurality of panels, and the other end wall comprising a panel recess configured to accommodate a male knob from another of the plurality of panels; one or more flanges, each of the one or more flanges extending from and rigidly fixed to the back side of one of the plurality of panels.

These and other features and advantages of aspects of the present invention will become apparent to those skilled in the art from the following detailed description, where it is shown and described illustrative embodiments, including best modes contemplated for carrying out the invention. As it will be realized, the various aspects of the invention are capable of modifications in various obvious respects, all without departing from the spirit and scope of the present invention. Accordingly, the drawings and detailed description are to be regarded as illustrative in nature and not restrictive.

DESCRIPTION OF THE DRAWINGS

FIG. 6A depicts a front view of a sport wall gate panel.

FIG. 6B depicts a rear view of the sport wall gate panel of FIG. 6A.

FIGS. 6C-F depict a top, first side, second side, and a bottom portion, respectively, of the sport wall panel depicted in FIG. 6A.

DETAILED DESCRIPTION OF THE INVENTION

Certain embodiments of the invention provide a sport wall and an enclosure system for use in athletic events such as hockey (inline and ice), soccer and indoor football. It will be understood that various sport walls described herein may be fabricated from high-strength materials, such as polyethylene and composite plastics, using various manufacturing methods, including molding, e.g., rotational molding, injection molding, reaction injection molding, machining, pressing and punching. The various aspects of the present invention are described below with reference to the figures.

Figure 1:
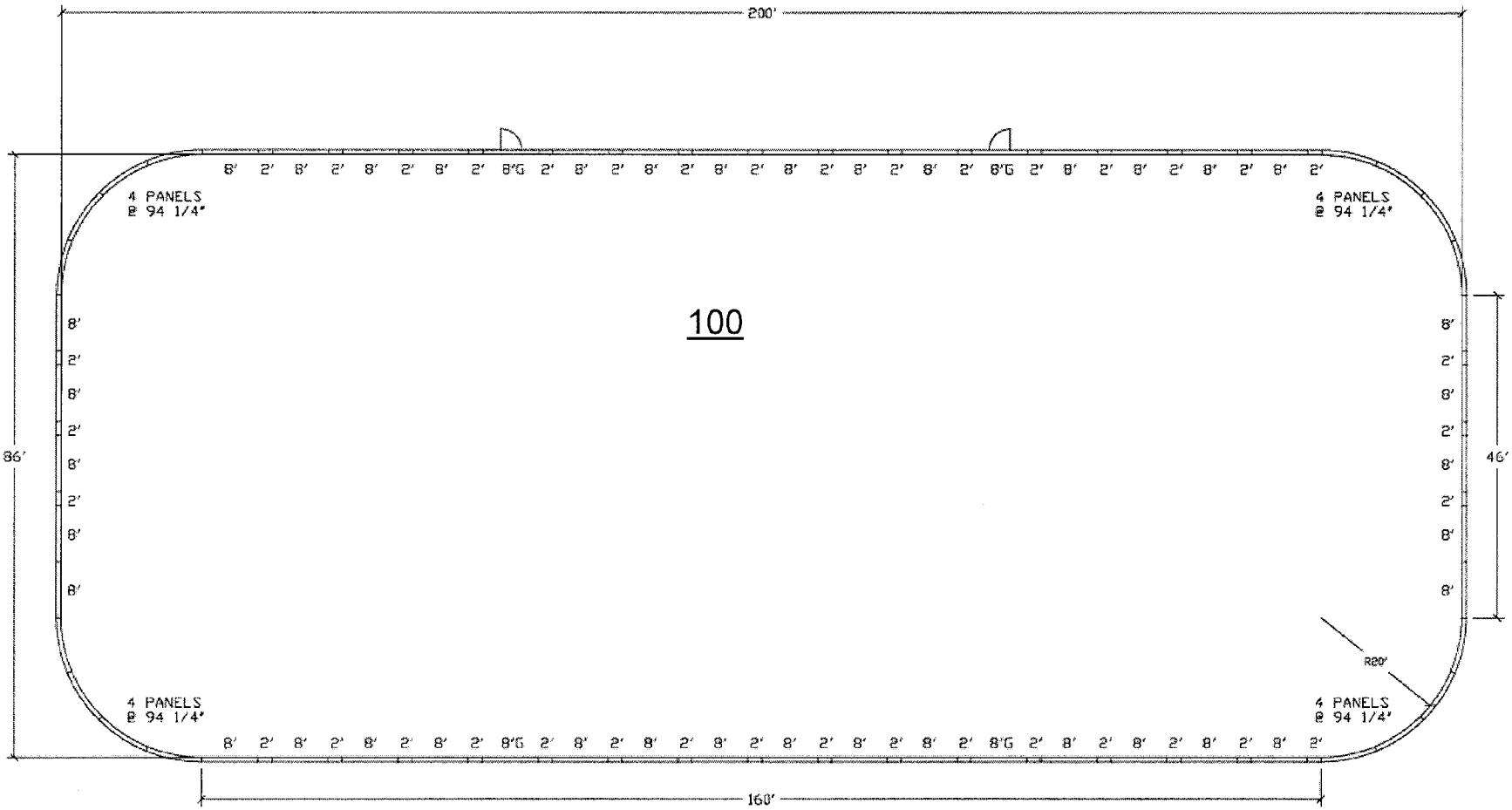
FIG. 1 depicts a top view of an 86'×200' enclosed sport wall system.

FIG. 1 depicts a top view of enclosed sport wall system 100 having dimensions of 86'×200', which implements the various types of sport wall panels described herein. In FIG. 1, the enclosed sport wall system includes 2' panels, 8' panels, 94¼" round panels having a 20' radius, and 8' gate panels. However, it should be understood that other sport wall panels may be used in addition or as an alternative to the sport wall panels depicted in the sport wall system of FIG. 1.

Figure 2A:
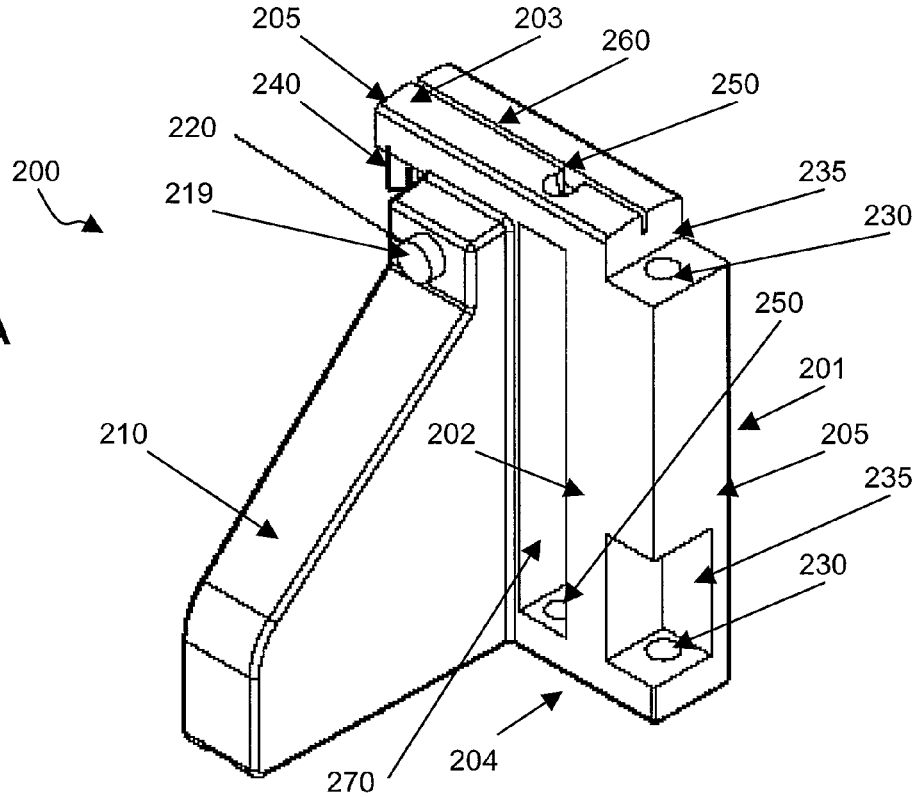
FIG. 2A depicts a perspective view of a sport wall and anchoring panel.

FIG. 2A provides a perspective view of an example sport wall and anchoring panel 200 for use in sport wall enclosure systems such as enclosed sport wall system 100, which includes: a front side 201, a back side 202, a top end 203, a bottom end 204, end walls 205, load bearing flange 210, fill opening 219 (not shown), fill opening cover 220, end wall recess 230, end wall cutout 235, male knob 240, protrusion 245, parallel top and bottom end recesses 250, and upper containment channel 260.

In FIG. 2A, sport wall and anchoring panel 200 may have a length ($L_{ASW}$) of 24", a width ($W_{ASW}$) of 8", and a height ($H_{ASW}$) of 42". Other dimensions of the sport wall and anchoring panel 200 are also suitable according to the invention. For example, sport wall and anchoring panel 200 may have a length of up to 125", a height ranging between 24-48" tall, and a width ranging between 2-12". Sport wall and anchoring panel 200 provides anchoring functionality along with the utility of a sport wall. As a result, when a user chooses to add sport wall and anchoring panel 200 to their sport wall enclosure system, they are also adding length to the interior enclosed sport wall system.

Figure 2B:
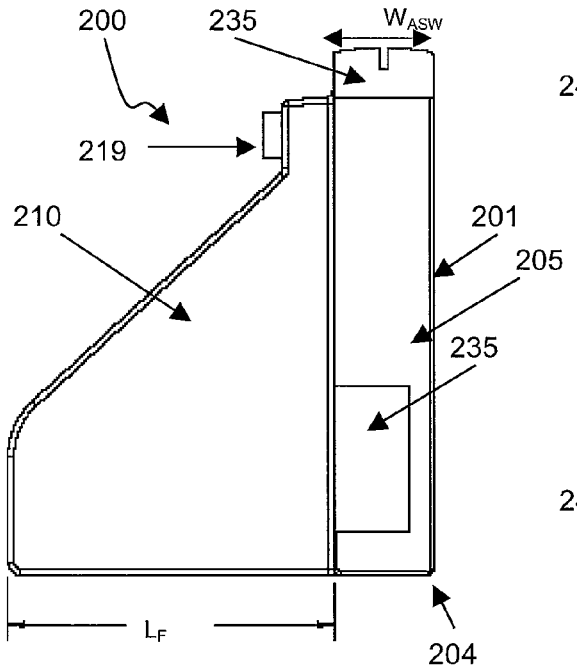
FIG. 2B depicts a side view of a sport wall and anchoring panel.

As can be seen at the right end of the side profile in FIG. 2B, sport wall and anchoring panel 200 is relatively smooth on its front side 201. This allows an assembled sport wall enclosure system to have a continuously smooth surface having only slight interruptions at the terminal ends of each panel. In some configurations, the front side 201 may also include kick plate structures, bumped out from the front side. In further configurations, the front side 201 is treated with coatings to provide various properties to the enclosure space. For example, providing a rubber-like coating may affect the bounce of a soccer ball.

The back side 202 of sport wall and anchoring panel 200 includes recessed areas described below, along with flange 210 for providing anchoring and support to sport wall and anchoring panel 200 and to other connected sport wall panels.

The top side 203 of sport wall and anchoring panel 200 includes an upper containment channel 260, for example, that measures ⅝" wide×1¾" deep, in order to accommodate chain-link fencing, netting and/or acrylic. In addition, a 2½"× 5" insert may be included at the top of sport wall and anchoring panel for customer identification.

The bottom side 204 of the sport wall and anchoring panel 200 may be configured with a planar surface or may include feet (not shown). In one example, feet may be adjustable to allow height adjustments when sport wall and anchoring panel rests 200 on uneven surfaces.

Figure 2C:
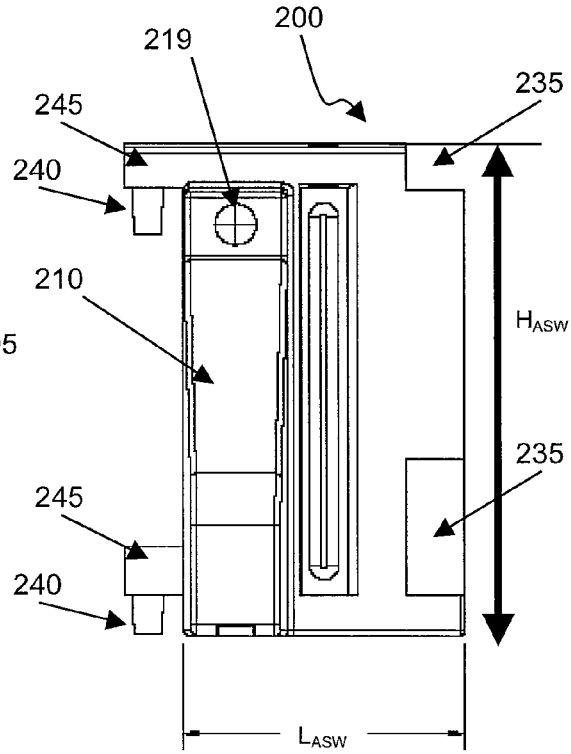
FIG. 2C depicts a front view of a sport wall and anchoring panel.

In addition, the end walls 205 of the sport wall and anchoring panel 200 include interlocking elements including two end wall recesses 230 and two male knobs 240 for connecting to other sport wall panels. The two end wall recesses 230 are arranged on the right side of sport wall and anchoring panel 200, one near the top and the other near the bottom. Each end wall recess 230 is arranged inside of an end wall cutout 235 as depicted in FIGS. 2A-C and is cup-shaped. The shape of the end wall recess 230 may be complementary to the shape of male knobs 240.

At the top of sport wall and anchoring panel 200, end wall cutout 235 is configured as a step, and near the bottom of sport wall and anchoring panel 200, end wall cutout 235 is configured as a block-shaped cut-out. The block-shaped cutout 235 near the bottom is deep enough to accept male knob 240 and protrusion 245, and does not extend through the front side of sport wall and anchoring panel 200.

Two peg-shaped male knobs 240, are included on an opposite side of sport wall and anchoring panel 200 from the positioning of end wall recesses 230. Male knobs 240 each are provided on a wall protrusion 245. The top protrusion 245 is configured like a continuous portion of the top surface of sport wall and anchoring panel 200 with male knob 240 extending from the bottom to face the bottom side of the sport wall and anchoring panel 200. The bottom protrusion 245 is configured like a block extending from the end wall of sport wall and anchoring panel 200 with male knob 240 extending from the bottom.

Figure 7A:
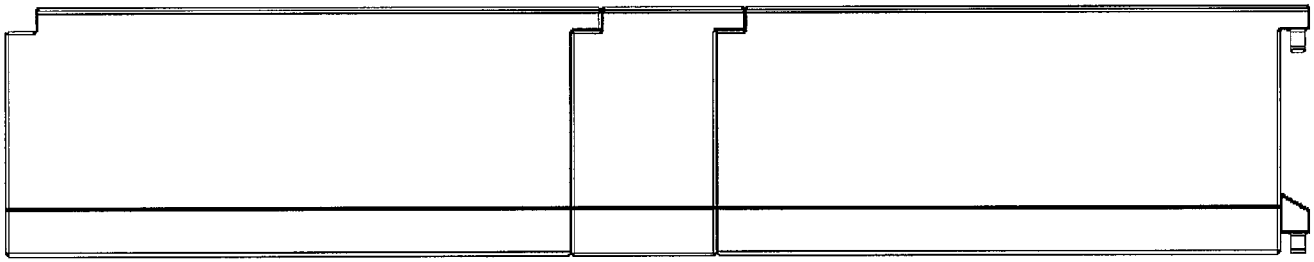
FIGS. 7A-B depict a front and back view of an assembled sport wall system.
Figure 7B:
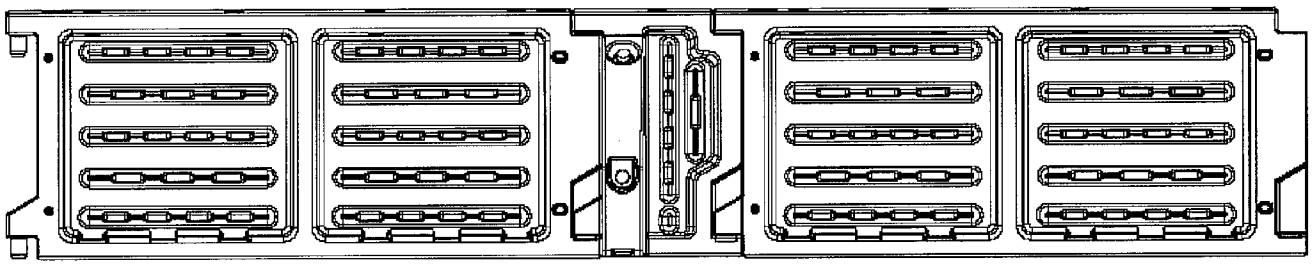
Figure 7C:
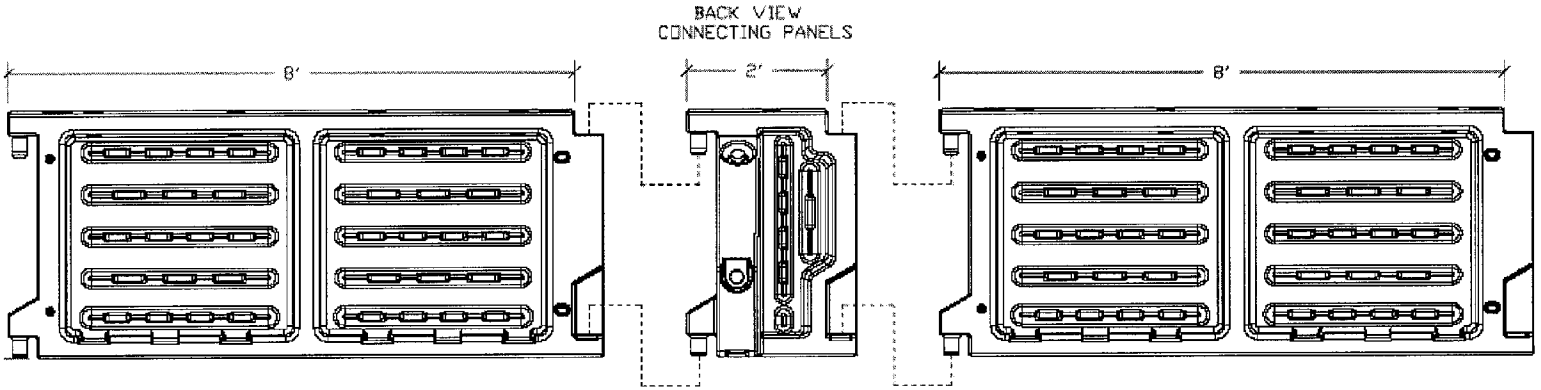
FIG. 7C depicts the assembly of three sport wall panels.

End wall recesses 230 on sport wall and anchoring panel 200 are arranged such that male knobs 240 from a second sport wall panel are insertable into the end wall recesses 230, and male knobs 240 on sport wall and anchoring panel 200 are each insertable into end wall recesses 230 from a third sport wall panel. For example, FIG. 7C depicts three separated sport wall panels, pre-assembled, and FIGS. 7A-B depict a front and back view of the assembled sport wall panels in which male knobs are dropped into end wall recesses. As a result, the configuration of end wall recesses should be complementary to male knobs from other panels and vice versa. According to some configurations, male knobs are between 2-5" long, and end wall recesses are correspondingly between 2-5" deep. The width of male knob 240 may be 2⅝", or male knob 240 may be between 1" and 3½" wide. The corresponding width of end wall recesses 230 may be sized to accommodate the width of male knob 240. In FIGS. 2A-C, lower end wall cutout 235 is sized to accommodate the combination of a lower protrusion and male knob of a neighboring panel to allow for their horizontal insertion into the end wall cutout 235 and for the vertical insertion of a male knob into lower end wall recess 230.

Upon assembly, end wall recesses 230 and male knobs 240 interlock thereby preventing panels from detaching via a horizontal or lateral movement, and secure and flexible connection is formed. That is, when resting on slightly uneven surfaces, connected panels may self-adjust and follow the contours of the surface while remaining securely connected because slight height differences will not cause the panels to separate, but rather the panels may be slightly raised/lowered due to slight changes in the ground elevation. In addition, when a non-linear configuration is desirable, panels may be connected and then adjusted so that they are set at an angle relative to each other while maintaining their secure connection.

In particular arrangements, end wall recesses 230 and end wall cutouts 235 are configured to correspond to a neighboring panel's male knobs 240 and protrusions 245 when in a starting or assembly position, but not when in a rotated or adjusted position. Such an arrangement may allow sport wall panels to initially join, and then upon rotation, lock both horizontally and vertically. For example, end wall recess 230 may have a key hole shape and male knob may have a key shape so that once male knob 240 is inserted into end wall recess 230 and the panel is rotated, the self-interlocking mechanism locks vertically and horizontally so that the panel may not be detached by being lifted vertically or horizontally apart, and the panels may remain locked together until they are rotated to their starting position.

Although end wall recess 230 is depicted as being cylindrical, end wall recess 230 may be configured with a variety of shapes, e.g., oval, semi-cylindrical, square and/or pointed. Further, top and bottom end wall cutout 235 may also have alternative configurations depending on the configuration of male knob 240 and protrusion 245, described below. Moreover, although male knobs 240 are depicted as being cylindrical and tapered, male knobs 240 may be configured with a variety of shapes, e.g., oval, semi-cylindrical, square and/or pointed.

In one configuration, knob 240 may be configured with a wide portion at a terminal end and a narrower portion at the connection point to the panel. After knobs 240 are dropped into place in a corresponding panel, and the panels are adjoined, a c-shaped part (not shown) could be slid over the narrower portion of knob 240, and attach to the corresponding adjoining panel near its end wall recess 230, thus trapping the wide portion of knob 240 inside of end wall recess. The diameter of the c-shaped portion may be configured to closely match the narrower portion of the knob 240, so that when the panel is lifted, the locked-in c-shaped portion prevents the wider portion of the knob, situated below the c-shape portion, from moving past and detaching from the corresponding panel. This configuration may be modified depending on whether the knob 240 and end wall recess 235 are at the upper or lower end of the panel.

In further configurations, fasteners may be formed on the sport wall panels or may be positioned on or inserted into sport wall panels in order to vertically and horizontally lock the sport wall panels together. For example, screws and complementary threading may be provided in the knob and recess areas of the sport wall panels.

In FIGS. 2A-C, sport wall and anchoring panel 200 further includes a support and anchoring flange 210. Flange is non-removably fixed to sport wall and anchoring panel and in use, rigidly fixed flange 210 rests on the ground but is not anchored into the ground like anchoring rods, for example. This provides advantages to an enclosed sport wall system when it is used on asphalt or surfaces in which openings for anchoring rods cannot be easily formed.

Figure 12:
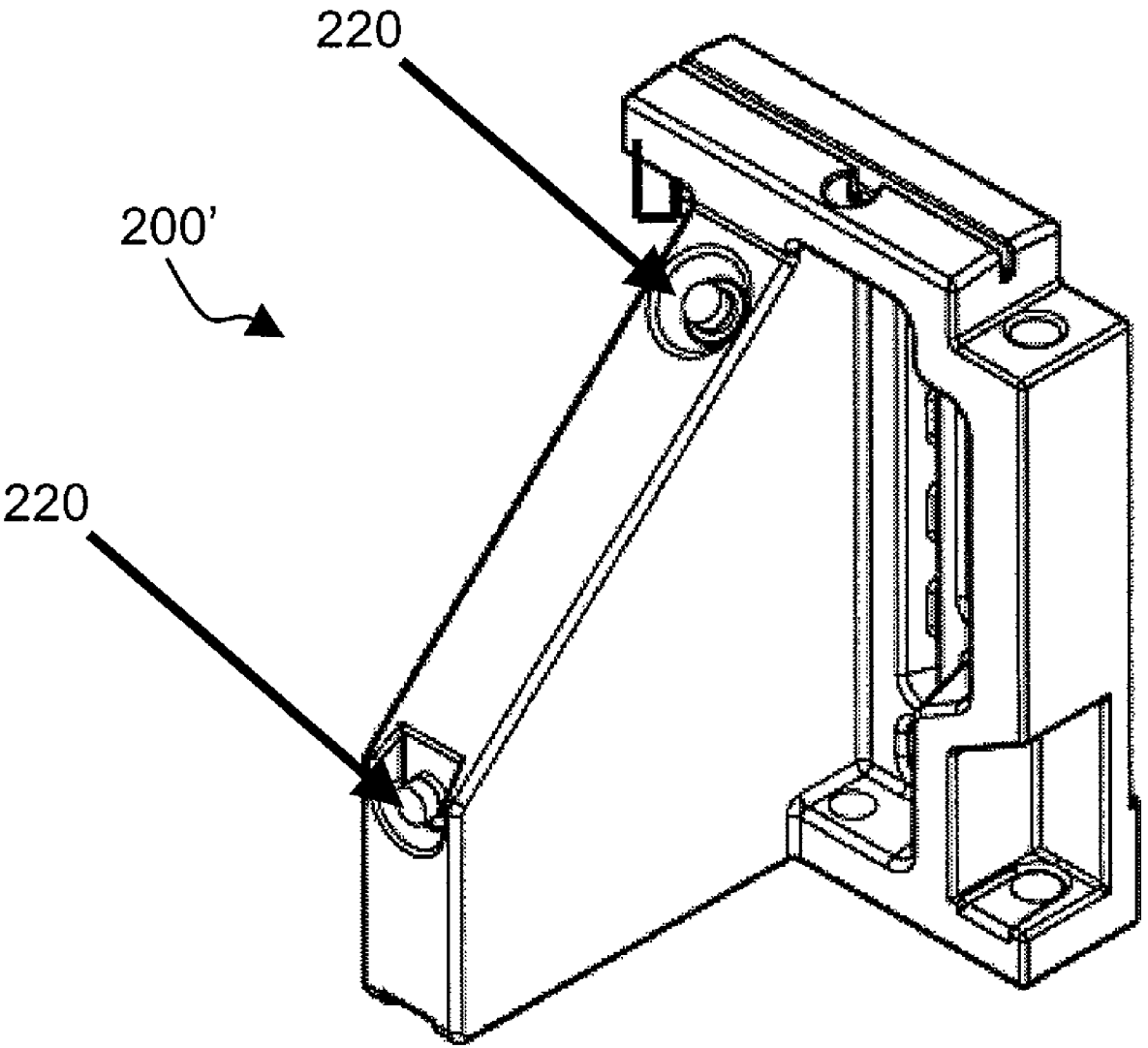
FIG. 12 depicts another perspective view of a sport wall and anchoring panel.

According to various configurations, flange 210 is constructed with a hollow interior and solid top, bottom, end and side walls and may be provided with one or more fill openings along a wall edge, along with a fill opening cover 220, e.g., a cap, for covering a flange opening, such as a 3.5" Kelch® fill neck. In FIG. 2A, one fill opening is provided and may be sealed by fill opening cover 220, while in FIG. 12, two fill openings on sport wall and anchoring panel 200' are provided and sealed by fill opening cover 220. The flange 210 with access to the hollow interior may enable a user to easily transport and assemble the sport wall system with the hollow flange interior, and then fill the interior of flange 210 with a filler material, e.g., fluids, gravel, sand, or any suitable filler material. When the sport wall is to be moved, the fill opening cover 220 may be removed and flange 210 emptied to allow for ease of movement and transport. Thus, providing a covering for the flange opening 219 (not shown), such as cap 220, enables the filler material to be retained in the hollow interior of flange 210 for added stabilization and anchoring. In addition, flange 210 may be provided with a drain opening (not shown) to allow filler material to be easily drained or removed from the hollow interior.

In certain implementations, the flange 210 and panel 200 may be manufactured using rotational molding in which flange 210 is an integral part of panel 200. In another example, flange 210 is formed separately from panel 200 and subsequently flange 210 permanently attached to panel 200, e.g., by fasteners, physical coupling, melting or welding.

In FIGS. 2A-C, triangular or wedge-shaped flange 210 is permanently fixed to sport wall and anchoring panel 200 and has a height of between 18" to 48", a length at its base of about 18" to 36" or approximately 26" and a width of between 4" and 8". The wedge shape of flange 210 terminates near the top of sport wall and anchoring panel 200, and may include an opening providing access to a hollow flange interior. The hollow flange interior may be capable of holding a volume of between 3000 and 6000 cubic inches of filler material, for example.

Although FIGS. 2A-C depict flange 210 as being wedge-shaped with its bottom end arranged along the same plane as the bottom of sport wall and anchoring panel, flange 210 may be configured in a variety of shapes having a variety of sizes to provide support and anchoring for sport wall and anchoring panel 200 along with other sport wall panels. For example, flange 210 may have a square, cone, cylinder, semi-cylinder or pyramid shape, and may be capable of holding a volume of between 1000 and 15,000 cubic inches of filler material.

Panel 200 further includes parallel top and bottom end recesses 250 for use in anchoring panel 200 to ground surfaces. The top and bottom end recesses may be separated by sport wall cutout 270. Rigid posts, e.g., 2½" OD steel posts (not shown), may be slid through the top and bottom of the panel through the parallel top and bottom end recesses 250 of panel 200 and into the ground surface, to anchor panel 200 to the ground.

Panel 200 may further be configured with additional anchoring mechanisms such as anchor plates (not shown), which may be used with bolts, e.g., ⅝" anchor bolts, so that panel 200 may be affixed into concrete surfaces.

In further embodiments, panel 200, like flange 210, may include a hollow interior that may or may not be accessible. For example, a hollow sport wall and anchoring panel 200 may be airtight, e.g., where vent openings are closed by spin welding polyethylene, may include ventilation openings, or may include sealable openings allowing filler materials to be deposited inside all or a portion of the hollow interior.

Figure 3A:
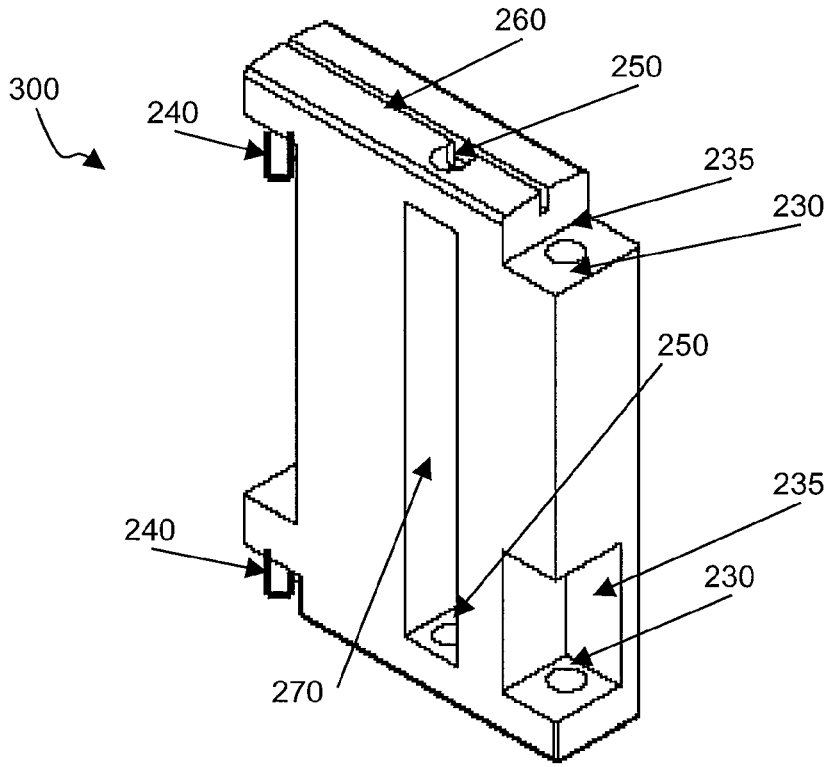
FIG. 3A depicts a perspective view of a sport wall panel.
Figure 3B:
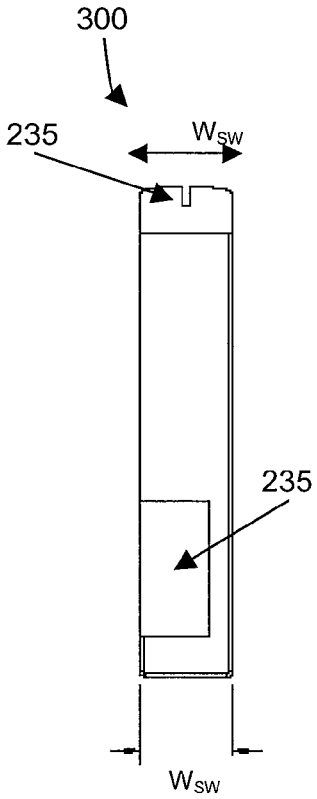
FIG. 3B depicts a side view of a sport wall panel.
Figure 3C:
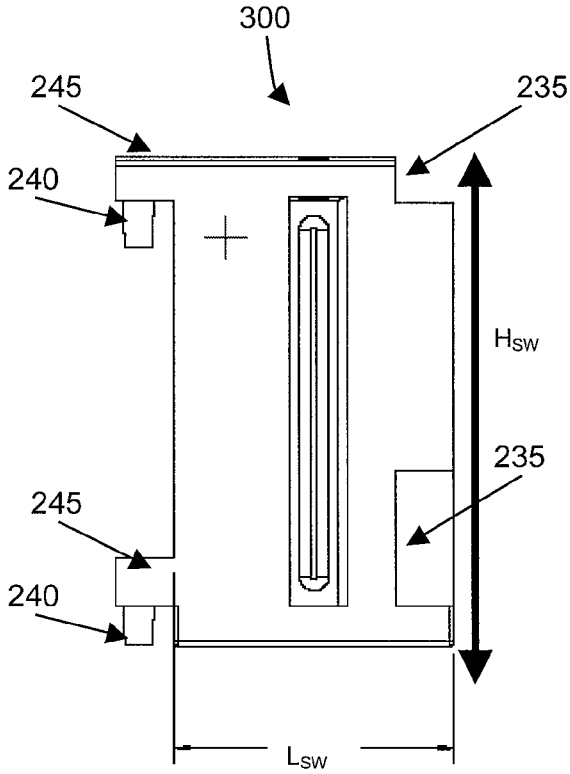
FIG. 3C depicts a front view of a sport wall panel.

FIGS. 3A-C depict a sport wall panel 300 having similar dimensions to the sport wall and anchoring panel 200, except that sport wall panel 300 does not include a flange for anchoring and stabilizing the panel. According to some implementations, sport wall panel 300 is used alone or in combination with sport wall and anchoring panel 200. When used in combination, sport wall panel 300 is stabilized at least in part by sport wall and anchoring panel 200.

Figure 8:
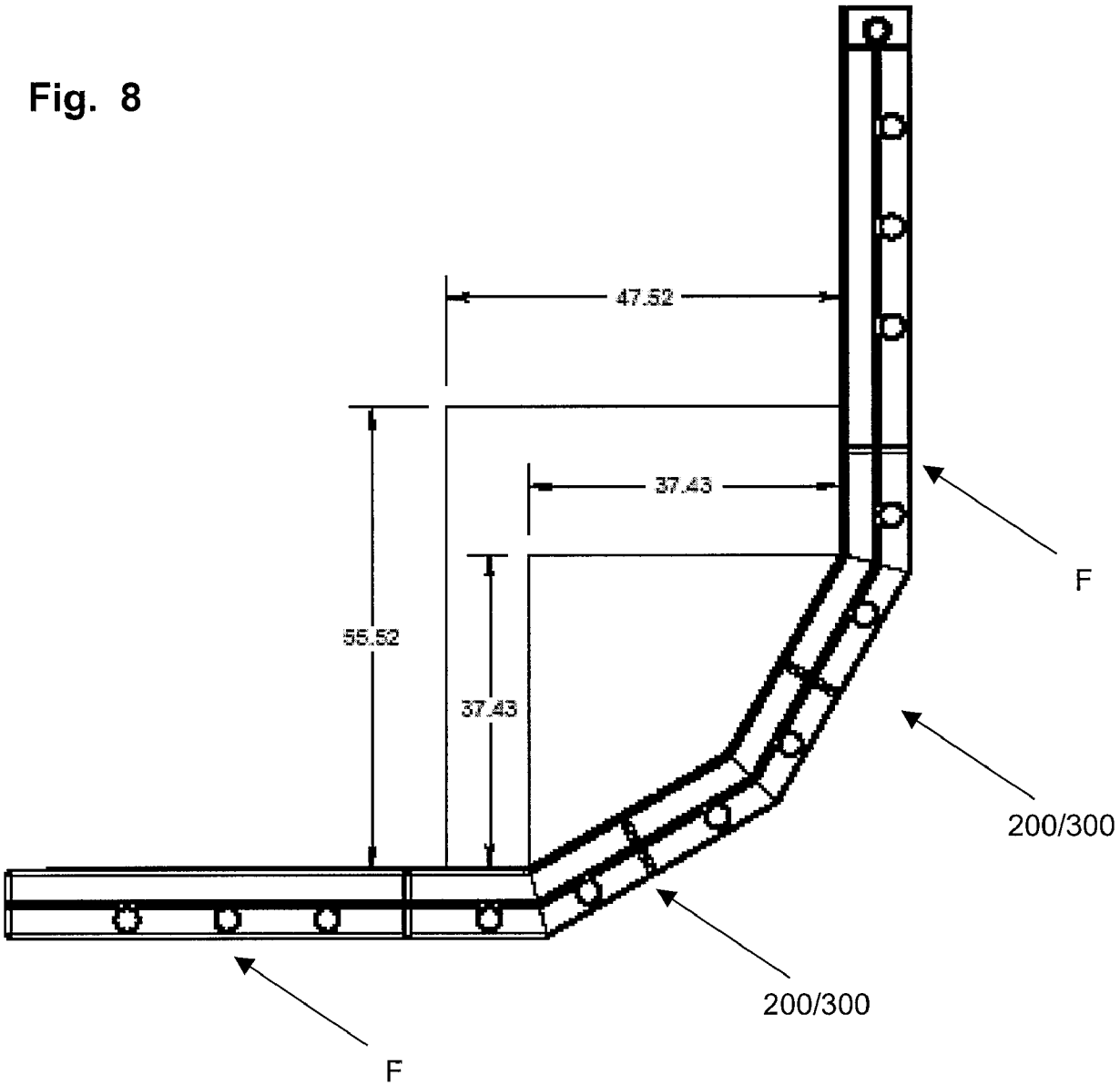
FIG. 8 depicts a top view of a corner portion of a sport wall system.
Figure 9B:
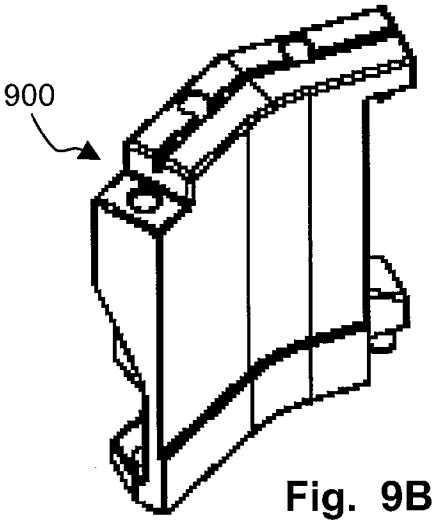
FIGS. 9A-D depict a back perspective, front perspective, top, and a front view of a 30 degree corner sport wall panel.
Figure 9D:
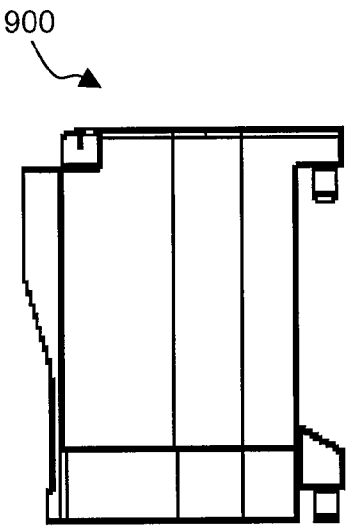
Figure 9A:
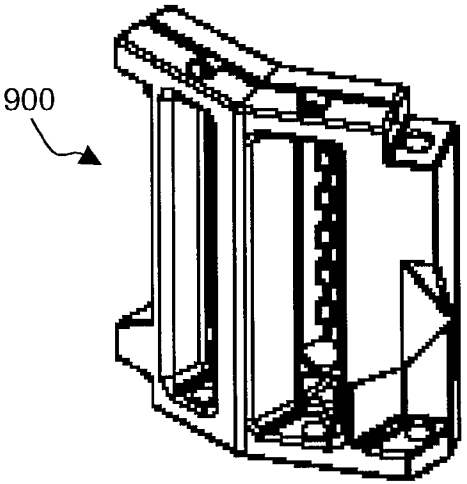
Figure 9C:
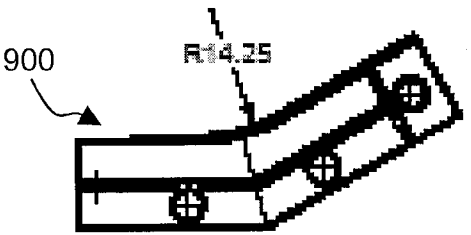
Figure 10A:
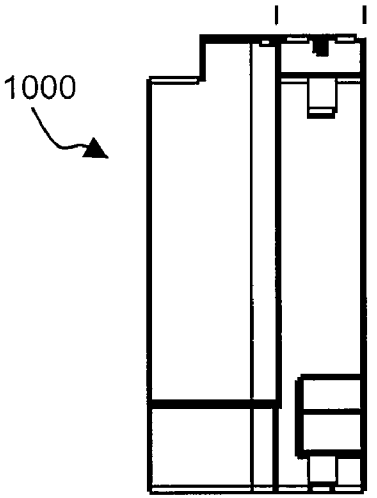
FIGS. 10A-D depict a first side, second side, top and perspective view of a 90 degree corner sport wall panel.
Figure 10B:
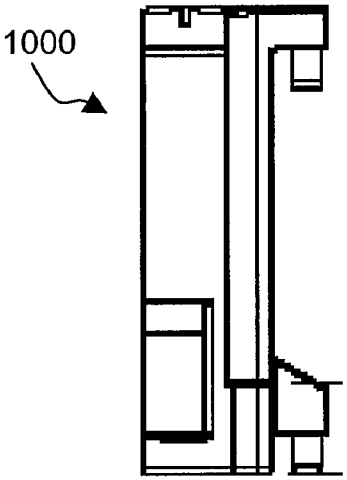
Figure 10C:
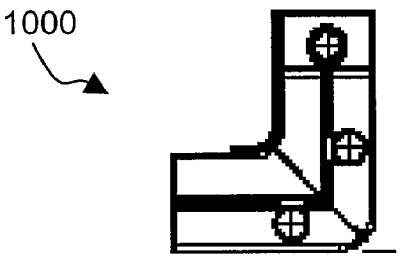
Figure 10D:
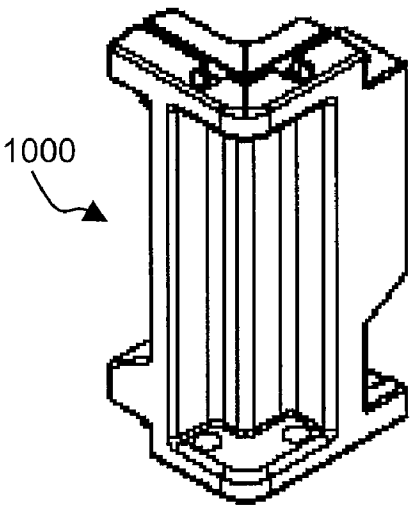

According to certain implementations, end wall recesses 230 and male knobs 240 adjoin one or more sport wall panels 300 and/or one or more sport wall and anchoring panels 200. The adjustable nature of the connection and the short length of each of the panels 200, 300 allows the panels to be interlocked and adjusted into an arc formation in order to form a short radius corner. In one configuration, panels 200, 300 fit in an arc-like manner in a 90-degree corner so that the arc begins between 28" and 48" from the corner's apex. In another configuration, each panel 200 or 300 may allow for a 30-degree angle relative to another panel so that combining successive panels at 30-degree angles allows for the creation of a 90-degree arc, a half circle, a complete circle, or an oval, for example. FIG. 8 depicts an example configuration of a number of panels 200/300 arranged along a corner. As can be seen, the two panels 200/300 are arranged at a 30-degree angle relative to each other, and are arranged at a 30-degree angle relative to their respective flanking sport walls F. As a result, the combined panels form a rounded 90-degree arc. Where panels 200/300 are each 24" in length, the arc formed from the combined panels may begin and end 32" from either side of a corner's apex.

It will be understood that sport wall panels 200, 300 may adjoin to each other and to other sport wall panels described below. For example, a series of sport wall panels 300 may adjoin and abut against a wall, thereby providing stabilization for sport wall panels 300 without the use of sport wall and anchoring panel 200. In addition, sport wall panels 300 include anchoring mechanisms such as parallel top and bottom end recesses 250 for accepting rigid posts and may include anchor plates for anchoring to concrete surfaces, for example.

FIGS. 4A-F depict front, back, first and second side and top and bottom views of a sport wall panel 400 that is 101" long, 42" tall, and 8" wide, which may be used in combination with sport wall panels 200 and 300 described above. Sport wall panel 400 includes male knobs and end wall recesses for connecting with other sport wall panels. However, the lower male knob is coupled to a protrusion having an angled top surface, as opposed to the planar top surface of protrusion 145 in FIGS. 2A and 2C. When the protrusion has such a configuration, end wall cutout may be configured with a complementary shape, e.g., the end wall cutout depicted FIG. 4B.

Sport wall panel 400 further includes a series of kissoffs 410, where the front side of the panel connects to the back side of the panel. Kissoffs may be staggered to provide additional strength to sport wall panel 400. In FIG. 4, 50 3"×⅜" kissoffs are staggered throughout the panel to provide additional panel strength. In addition, sport wall panel 400 includes a kick plate 415 along the length of the front wall, which may have a thickness of about ½", or between ¼" to 1".

FIGS. 5A-F depict front, back, first and second side and top and bottom views of a curved sport wall panel 500 that includes male knobs and end wall recesses for connecting with other sport wall panels. Its dimensions may be similar to those of sport wall panel 500, except that the front and back walls are curved to form a curve having between a 16' to 20' radius when multiple panels 500 are coupled end-to-end. However, panel 500 may be configured so that assembled panels 500 form a larger or smaller radius curve, e.g., a curve having a 2' to 30' radius. In one example, the curved sport wall panel 500 has a length of 94¼". In another example, the curved sport wall panel may have a length between 24" and 125" and a height between 24" and 48". In addition, the curved sport wall panel 500 may be configured with various curvatures. For example, the radius of the curved sport wall 500 may be configured smaller than a typical ice rink curved sport wall panel so that a closed sport wall system may still be assembled when an indoor arena is sized smaller than a traditional hockey rink.

FIGS. 6A-F depict front, back, first and second side and top and bottom views of a sport wall gate panel 600 having a top length of 101", a bottom length of 96", a width of 8" and a height of 42" that includes male knobs and end wall recesses for connecting with other sport wall panels. In FIGS. 6A-C, an example gate opening is shown as having a height of 33.5" and a width of 36". However, as with the other sport panels described above, sport wall gate panel 600 and its gate opening may have a variety of dimensions. In addition, the sport wall gate panel 600 may be configured so that it can accommodate ice hockey gate hardware, e.g., latches and hinges, in order to hold a gate (not shown). In particular implementations, a gate may be attached to sport wall gate panel 600 so that it is a left-swing or a right-swing gate. The sport wall gate panel 600 may further include an 8" threshold/stepover. Providing a sport wall gate panel 600 may enable players to easily enter and exit an enclosed sport wall system.

FIGS. 9A-D depict a back perspective, front perspective, top and front view of 30 degree sport wall panel 900. FIGS. 10A-D depict a first and second side, top and perspective view of 90 degree sport wall panel 1000. Each of sport wall panel 900 and 1000 may be used in addition to or as an alternative to sport wall panels 200-600, and may provide corner regions for an enclosed sport wall system.

Figure 11A:
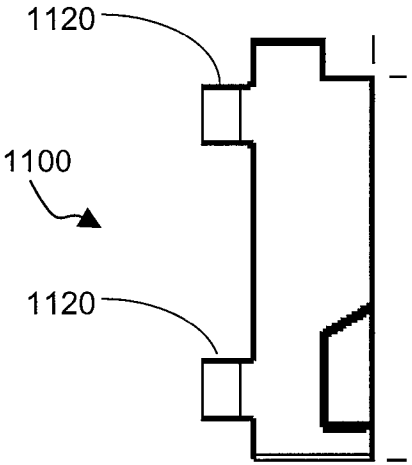
FIGS. 11A-B depict a first and perspective view of a female T-adapter.
Figure 11B:
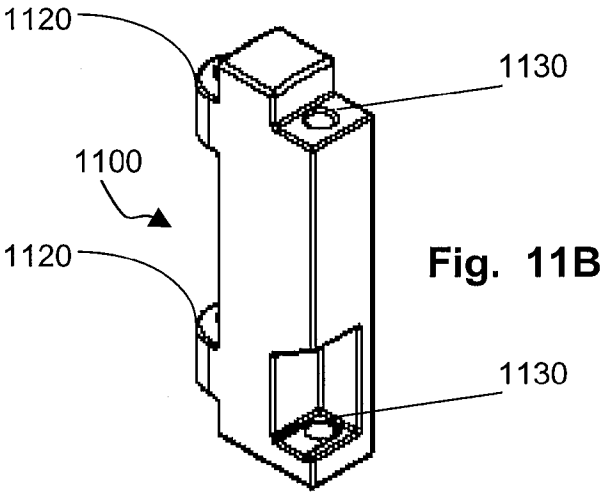
Figure 11C:
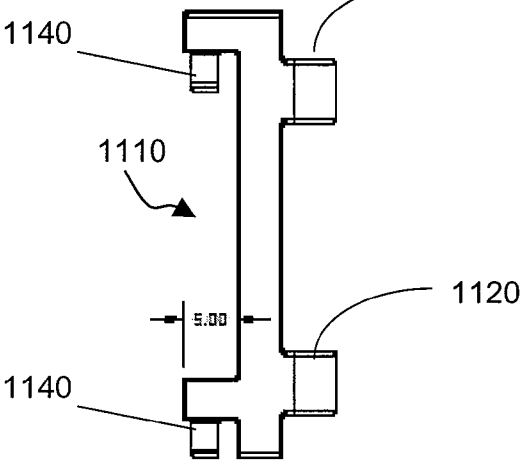
FIGS. 11C-D depict a first and perspective view of a male T-adapter.
Figure 11D:
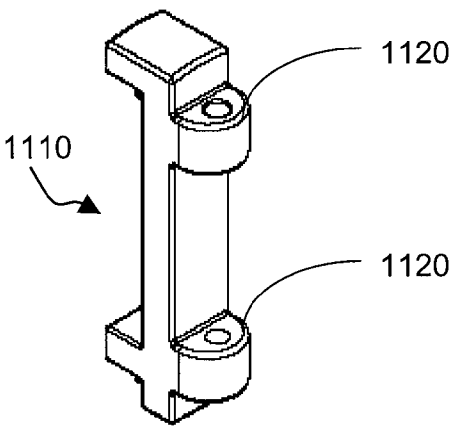

FIGS. 11A-B depict a first and perspective view of a female adapter panel 1100, and FIGS. 11C-D depict a first and perspective view of male adapter panel 1110 for use with an enclosed sport wall system. The adapter panels may be arranged in the sport wall system when it is configured to include additional partitioned sections, e.g., a bench area or a penalty box. The adapter panels include crescent-shaped coupling end 1120 and upper and lower recesses 1130 (FIGS. 11A-B) or male knobs 140 (FIGS. 11C-D). In use, adapter panels 1100, 1110 are coupled to the back of a sport wall panel by inserting coupling end 1120 into, for example, sport wall cutout 270 (see FIGS. 2A and 3A), and once inserted, a pipe, e.g., steel or PVC pipe, may be inserted through top end recess 250, upper and lower coupling ends 1120, and bottom end recess 250, in order to secure adapter panel 1100, 1110 to the sport wall panel. Depending which end of a sport wall panel is to be coupled to the adapter determines whether the female adapter panel 1100 or male adapter panel 1110 is employed. By providing the adapter panel on the back side of the sport wall panel, various enclosures may be constructed using the above-described sport wall panels. For example, two adapter panels may be coupled to the sport wall enclosure system and spaced apart by 10' to 15', and a series of sport wall panels, e.g., sport wall 200-600 and/or 900-1110, may be coupled to the adapter panels and to each other to form an enclosure having a square, rectangular, semi-circular, semi-hexagonal, or any suitable enclosure shape. In a further example, adapter panels may be coupled to the sport wall enclosure system in order to form multiple sporting enclosures, e.g., two enclosed sport wall systems 100 sharing a common wall, e.g., the 160' or 86' wall.

Figure 4B:
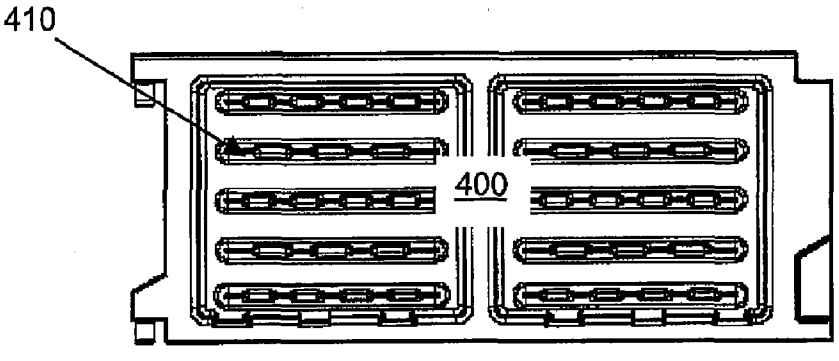
FIG. 4B depicts a rear view of the sport wall panel of FIG. 4A.
Figure 4A:
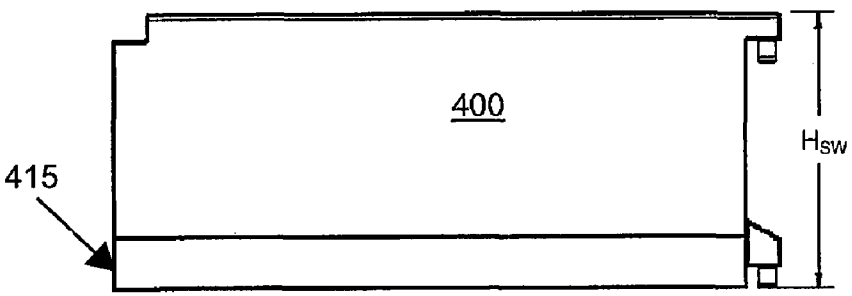
FIG. 4A depicts a front view of a sport wall panel for use with or without the sport wall and anchoring panel.
Figure 4E:
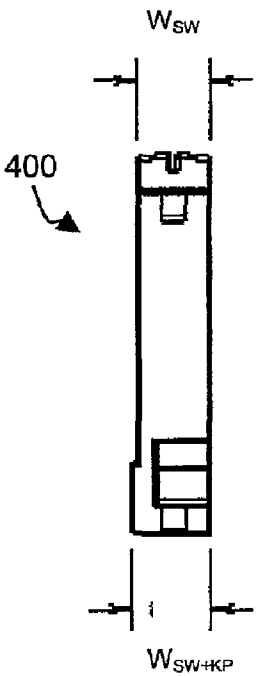
FIGS. 4C-F depict a top, first side, second side, and a bottom portion, respectively, of the sport wall panel depicted in FIG. 4A.
Figure 4C:
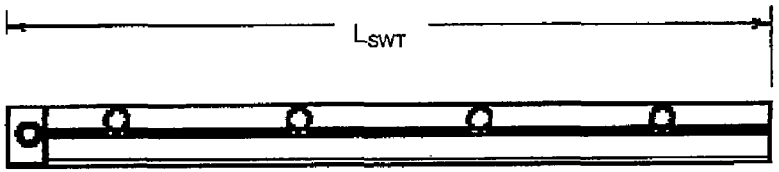
Figure 4F:
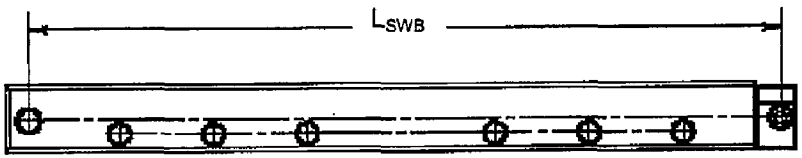
Figure 4D:
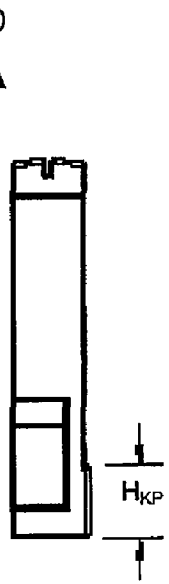
Figure 5B:
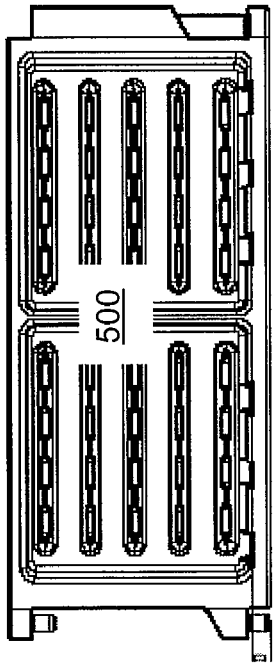
FIG. 5B depicts a rear view of the curved sport wall panel of FIG. 5A.
Figure 5A:
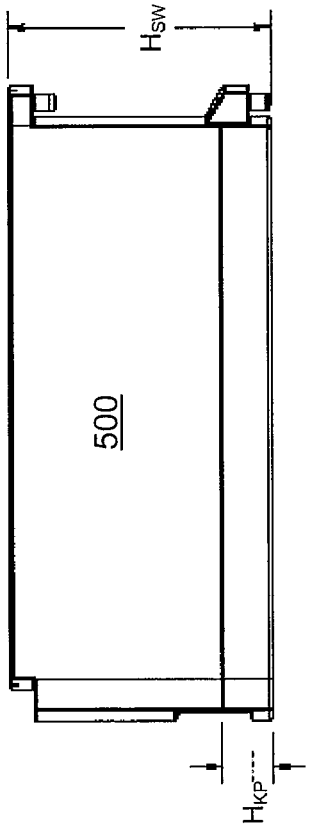
FIG. 5A depicts a front view of a curved sport wall panel for use with the sport wall and anchoring panel.
Figure 5C:
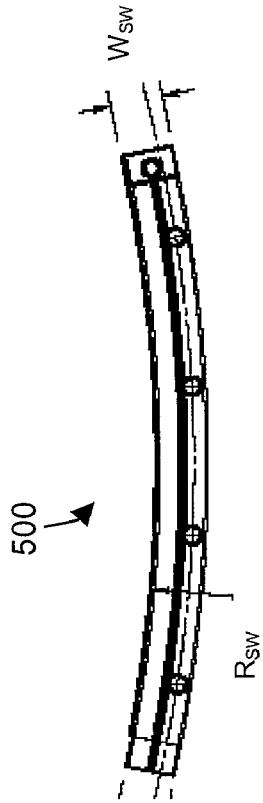
FIGS. 5C-F depict a top, first side, second side, and a bottom portion, respectively, of the sport wall panel depicted in FIG. 5A.
Figure 5E:
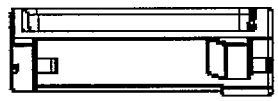
Figure 5D:
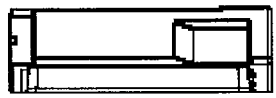
Figure 5F:
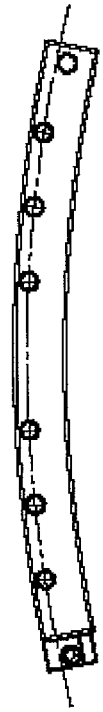

In use, the various sport wall panels described above, e.g., sport walls 200 to 600 and 900-1110, may be used alone or in combination to form an enclosed sport wall system. From FIGS. 2A-C, 3A-C, 4D-E, 5D-E, 6D-E, 9A-D, 10A-D, 11A-D and 12, it can be seen that the various panels 200-600 and 900-1100 may be interconnected using male knobs and panel recesses. Although sport wall and anchoring panel 200, with its rigid flange 210, may be used to anchor and stabilize the enclosed sport wall system, other anchoring mechanisms may also be used. For example, top views of the panels 400-600, e.g., FIGS. 4C, 5C, and 6C, depict four top end wall recesses for accepting rigid posts, and the bottom views of panels 400-600, e.g., FIGS. 4F, 5F, and 6F, depict four bottom end recesses, parallel to the top end wall recesses, that allow rigid posts to extend through the bottom end and into the ground.

It should be understood that any of the aforementioned panels may include a flange for providing support and anchoring to the enclosed system. However, it is contemplated that a number of the 2' panels, e.g., 6, 12, 24 or 36, may be configured with a flange for providing anchoring and support. In addition, other anchoring and support mechanisms may also be employed, such as those described above in relation to FIGS. 2A-C. It will be understood that depending on the size of the enclosed sport wall system, the number and type of anchoring and support mechanisms used in the enclosed sport wall configuration may vary.

Although the above sport wall panels have been described as having a pair of male knobs on one end wall and a pair of end wall recesses on an opposite end wall, alternate configurations are also contemplated. For example, some sport wall panels may include a pair of male knobs on both end walls, while other sport wall panels may include a pair of end wall recesses on both end walls. In another configuration, one male knob and one end wall recess is provided on each panel. Alternatively, three or more male knobs and a corresponding or differing number of end wall recesses may be provided for each panel. In yet another configuration, male knobs may extend towards the top of the sport wall panel and end wall recesses may face towards the bottom of the sport wall panel. In another configuration, male knobs may be adjustable so that they face the bottom of the panel in one position and the top of the panel in another position. This may be accomplished by providing a male knob that is slidable along its flange and lockable into a desired position. Such a configuration may be useful with reversible panels, described below.

In addition, sport wall panels are contemplated as having alternate configurations from those described above. In one embodiment, the front and back side of the sport wall panel may both have surfaces suitable for an interior of a sport wall enclosure system, allowing the panels to be reversible. In a particular example, one side of the sport wall panel may have a continuously smooth surface, while the opposite side may have a smooth surface with a kick plate along its length. In such a configuration the end wall cutouts may be cut into the end wall portion of the sport wall panel without interrupting the surface of the front or back side, and the protrusions with male knobs may extend from the side of the panel in a manner that corresponds to the end wall cutouts of other sport wall panels.

In another alternate configuration, sport wall panels may have a straight portion along its length and a curved portion along another portion of its length. In a further configuration, a single sport wall panel may be configured at an angle, e.g., 45, 60, or 90-degree angle, so that it serves as a corner sport wall panel, thus allowing all or a portion of the enclosure space to resemble an octagon, hexagon, square or rectangle. Accordingly, angled sport wall panels provide the sport wall system with enclosure shape flexibility. In a further example, an enclosure may be D shaped, e.g., with two 90-degree corners at one end and a curvature of 180-degrees at the opposite end. In another example, 90-degree corners and 90-degree arcs may alternate.

Some of the embodiments provide one or more advantages over other dasherboard systems because, unlike traditional dasherboard systems, the permanently affixed flange may have any desirable width and height. This is in contrast to prior systems where the dimensions of support legs are constrained by the storage area in the dasherboard panel into which they are required to fit. Further, unlike traditional dasherboard systems, the present invention can be easily moved and anchored and re-anchored due to the present invention's use of a stabilizing and anchoring flange and of upper and lower male knobs and upper and lower recessed areas on each panel. The panel may be easily moved because the stabilizing and anchoring flange does not need to be anchored into the ground to provide support to the sport wall system. In addition, the interlocking mechanisms allows one panel to adjoin another panel by dropping upper and lower male knobs from one panel into a recessed area on an adjoining panel to hold the panels together. In addition, because the male knobs can be dropped into the recessed areas, or vice versa, no tooling is necessary. Further, because the panels are interlocking, connecting dowels are unnecessary, thereby removing the chance of loss or breakage. The interlocking components of the interlocking mechanism, in addition, are hidden attachments due to the male knobs being accepted into end wall recesses disposed in end wall cutouts, thus allowing the interlocking components to be constructed of various materials, i.e., the same material or a different material than the visible portions of the assembled panel.

From the above description and drawings, it will be understood by those of ordinary skill in the art that the particular embodiments shown and described are for purposes of illustration only and are not intended to limit the scope of the present invention. Those of ordinary skill in the art will recognize that the present invention may be embodied in other specific forms without departing from its spirit or essential characteristics. References to details of particular embodiments are not intended to limit the scope of the invention.

What is claimed is:

1. An anchoring panel for a sport wall system comprising: a panel and a means for stabilizing the panel;

wherein the panel comprises:

a front side facing an interior of the sport wall system;

a back side;

a top side and a bottom side, the front side and back side arranged therebetween; and a first and second end wall, the front side and back side arranged therebetween, wherein each of said first and second end walls comprise interlocking elements for interlocking with a first or second end of another panel in the sport wall system, said interlocking elements comprising at least a male knob extending towards the bottom side of the panel and configured to be insertable into an end wall recess of the another panel in the sport wall system, wherein the end wall recess is formed on the bottom surface of a block shaped cutout that terminates prior to reaching each of the front side and the top side of the another panel;

wherein the means for stabilizing said anchoring panel is rigidly connected to, and extending at a right angle from a middle portion of the back side, wherein said rigid connection between the panel and means for stabilizing is unitarily formed by a molding manufacturing process, and wherein each means for stabilizing comprises a discrete hollow interior separate from the panel and an opening for providing access to the hollow interior such that when the means for stabilizing is filled with a stabilizing material via the opening, the stabilizing material is separated from the panel; and wherein when the anchoring panel and the another panel are connected to form the sport wall system, one of the end walls of the anchoring panel is in abutting contact with one of the end walls of the another panel.

2. An anchoring panel for a sport wall system comprising:

a panel and a flange;

wherein the panel comprises:

a front side;

a back side;

a top side and a bottom side, the front side and back side arranged therebetween; and a first and second end wall, the front side and back side arranged therebetween, wherein each of said first and second end walls comprise interlocking elements for interlocking with a first or second end of another panel in the sport wall system, said interlocking elements comprising at least a male knob extending towards the bottom side of the anchoring panel and configured to be insertable into an end wall recess of the another panel in the sport wall system, wherein the end wall recess is formed on a bottom surface of a block shaped cutout that terminates prior to reaching each of the front side and the top side of the panel;

wherein the flange is rigidly connected to, and extends at a right angle from a middle portion of the back side of the panel to provide anchoring for the anchoring panel in the sport wall system, wherein said rigid connection between the panel and flange is unitarily formed by a molding manufacturing process, and wherein said flange comprises a discrete hollow interior separate from the back side and a flange opening for providing access to the hollow interior such that when the flange is filled with an anchoring material via the flange opening, the anchoring material is separated from the panel; and wherein when the anchoring panel and the another panel are connected to form the sport wall system, one of the end walls of the anchoring panel is in abutting contact with one of the end walls of the another panel.

3. The anchoring panel of claim 2, wherein the flange is wedge-shaped and comprises a width of about 8" a height of about 40" and a length of about 26".

4. The anchoring panel of claim 2, wherein a bottom side of the flange is arranged on a same plane as the anchoring panel bottom side.

5. The anchoring panel of claim 2, wherein the front side of the anchoring panel is relatively flat and provides a sporting wall surface configured to withstand contact as a result of sports activity; and wherein when the anchoring panel and the another panel are connected, the front side of the anchoring panel and a front side of the another panel form a continuously smooth surface having only slight interruptions at the terminal ends of each panel.

6. The anchoring panel of claim 5, further comprising a fill opening cover for covering access to the flange hollow interior.

7. The anchoring panel of claim 2, wherein at least one protrusion extends from said first or second end wall, the protrusion accommodating a first end of a second male knob.

8. The anchoring panel of claim 7, wherein the top side comprises a stepped surface having a depth corresponding to a height of the at least one protrusion.

9. The anchoring panel of claim 8, wherein the stepped surface having the depth further comprises a hollow recess capable of receiving the second male knob from the another first or second end of the another panel.

10. An anchoring panel for a sport wall system, the anchoring panel comprising:

a panel and a flange;

wherein the panel comprises:

a front side;

a back side, said front and back side comprising a length of about 18" to 108" and a height of about 24" to 48";

a top side and a bottom side, the front side and back side arranged therebetween;

a first and second end wall, the front side and back side arranged therebetween, wherein the first and second end wall and top and bottom side form the width of the panel, wherein the width of the panel is about 2" to 12";

at least two cylindrically-shaped male knobs arranged on the first end wall at an upper and lower portion of the panel via a wall protrusion extending from the end wall, wherein the male knobs extend from a bottom of the wall protrusion toward the bottom side of the panel, wherein the male knobs comprise a length of about 2" to 5" and a diameter of about 1" to 3½"; and at least two end wall recesses arranged on the second end wall at an upper and lower portion of the panel, wherein at least one of the end wall recesses is formed on a bottom surface of a block shaped cutout that terminates prior to reaching each of the front side and the top side of the panel, said end wall recesses comprising a length of about 2" to 5" and a diameter of about 1" to 4";

wherein flange is rigidly connected to, and extends at a right angle from a middle portion of the back side of the panel to provide anchoring for the anchoring panel in the sport wall system, wherein said rigid connection between the panel and flange is unitarily formed by a molding manufacturing process, and wherein said flange comprises a discrete hollow interior having a wedge-shape separate from the back side and a flange opening for providing access to the hollow interior such that when the flange is filled with a filling material via the flange opening, the filling material is separated from the panel, wherein the flange is about 18" to 48" high with a width of about 4" to 8", said wedge-shape of the flange widening as the flange extends to the bottom side of the anchoring panel and comprises a length of about 18" to 36"; and wherein when the anchoring panel and another panel are connected to form the sport wall system, one of the end walls of the anchoring panel is in abutting contact with one of the end walls of the another panel.

11. The anchoring panel of claim 10, wherein the front side and back side are curved.

12. The anchoring panel of claim 10, wherein the front side and back side form between a 30 and 90-degree angle.

13. A sport wall system comprising:

a plurality of adjacently arranged panels forming an enclosed sporting area, each of the plurality of panels comprising:

a front side facing an interior of the enclosed sporting area;

a back side;

a top and bottom side, the front and back side arranged therebetween; and first and second end walls, the front and back side arranged therebetween, wherein each of said first and second end walls comprise interlocking elements for interlocking with another of the plurality of panels, said first or second end wall interlocking elements comprising at least a male knob extending towards the bottom side of the anchoring panel configured to be insertable into a panel recess of the another first or second end of another of the plurality of panels, and the other end wall comprising a panel recess configured to accommodate a male knob from another of the plurality of panels, wherein the panel recess is formed on a bottom surface of a block shaped cutout that terminates prior to reaching each of the front and the top side of the panel;

wherein one or more of the plurality of panels comprises an anchoring flange, the anchoring flange rigidly connected to and extending at a right angle from a middle portion of the back side of one of the plurality of panels, wherein said rigid connection between the panel and flange is unitarily formed by a molding manufacturing process, and wherein each flange comprises a discrete hollow interior separate from the panel and a flange opening for providing access to the hollow interior such that when the flange is filled with an anchoring material via the flange opening, the anchoring material is separated from the panel; and wherein when the plurality of panels are connected, end walls of the plurality of panels are in abutting contact with end walls of the adjacently arranged panels.

14. The sport wall system of claim 13, wherein the front side is relatively flat and provides a sporting wall surface configured to withstand contact as a result of sports activity; and wherein when the plurality of panels are connected, the front side of one of the plurality of panels and the front side of another of the plurality of panels form a continuously smooth surface having only slight interruptions at the terminal ends of each panel.

15. The sport wall system of claim 13, wherein one or more of the plurality of panels comprises a panel gate.

16. The sport wall system of claim 13, wherein one or more of the plurality of panels comprises a curved panel.

17. The sport wall system of claim 13, wherein one or more of the plurality of panels comprises a kick plate.

18. The sport wall system of claim 13, wherein one or more of the plurality of panels comprise a hollow space between the front and back wall.

19. The sport wall system of claim 18, wherein a plurality of kissoffs couple an interior of the front wall to an interior of the back wall.

20. The sport wall system of claim 13, wherein the plurality of panels are constructed of polyethylene.

* * * * *